United States Patent [19]

Saito et al.

[11] 4,365,751

[45] Dec. 28, 1982

[54] TRIGGER TYPE LIQUID INJECTOR

[75] Inventors: Tadao Saito; Takaharu Tasaki, both of Tokyo, Japan

[73] Assignee: Yoshino Kogyosho Co., Ltd., Tokyo, Japan

[21] Appl. No.: 220,073

[22] Filed: Dec. 24, 1980

[30] Foreign Application Priority Data

| | | | |
|---|---|---|---|
| Sep. 26, 1980 | [JP] | Japan | 55-133741 |
| Oct. 1, 1980 | [JP] | Japan | 55-139800[U] |
| Oct. 6, 1980 | [JP] | Japan | 55-142537[U] |
| Oct. 15, 1980 | [JP] | Japan | 55-146519 |

[51] Int. Cl.[3] ..... B05B 9/043

[52] U.S. Cl. ..... 239/333; 222/212; 222/380; 222/383; 222/496; 239/490; 239/533.1

[58] Field of Search ..... 239/333, 375, 458, 464, 239/533.1, 490; 222/207, 212, 380, 382, 383, 494–496

[56] References Cited

U.S. PATENT DOCUMENTS

| | | | |
|---|---|---|---|
| 3,061,202 | 10/1962 | Tyler | 222/380 |
| 3,159,316 | 12/1964 | O'Donnell et al. | 222/380 |
| 3,685,739 | 8/1972 | Vanier | 222/383 |
| 4,017,031 | 4/1977 | Kishi et al. | 239/333 |
| 4,082,223 | 4/1978 | Nozawa | 239/333 |
| 4,204,614 | 5/1980 | Reeve | 222/207 |
| 4,241,853 | 12/1980 | Pauls et al. | 222/207 |

*Primary Examiner*—John J. Love
*Assistant Examiner*—Michael J. Forman
*Attorney, Agent, or Firm*—Stevens, Davis, Miller & Mosher

[57] ABSTRACT

Herein disclosed is a trigger type liquid injector which includes a body mounted to stand on a liquid container, an injection cylinder extending in a horizontal direction from the upper portion of the body, and pumping means arranged at such an interior angle as is defined by the body and the injection cylinder. There is mounted in the base of the injection cylinder a discharge valve which is opened by the internal pressure in a pump chamber when this pressure exceeds a predetermined level. There is mounted on the front portion of the injection cylinder a nozzle cap which can change the states of the liquid being injected. The pumping means is actuated by the engagement between a recessed portion formed in a piston member and a trigger.

6 Claims, 12 Drawing Figures

TRIGGER TYPE LIQUID INJECTOR

BACKGROUND OF THE INVENTION

1. Field of the Invention

The present invention relates to a trigger type liquid injector, and more particularly to a liquid injector of the above type which has its construction simplified while facilitating the operation and improving the atomizing function of the device.

2. Description of the Prior Art

Many trigger type injectors are known in the prior art as a kind of the trigger type liquid injector. As is different from the case of a longitudinal reciprocating pump type manual atomizer, the trigger type atomizer has its built-in pump actuated by the operation of a trigger so that its construction stressing especially the pump mechanism is liable to become complex. In the trigger type atomizer, moreover, since the atomizing pressure at the beginning and end of the atomizing operation is insufficient, the liquid droplets atomized become coarse. In order to eliminate these drawbacks, there has been proposed a construction, in which a liquid under a high pressure can be atomized through a discharge valve only when the pressure in the pump chamber exceeds a predetermined level. The construction thus proposed is also liable to become complex so that simplification has been desired.

SUMMARY OF THE INVENTION

It is therefore a primary object of the present invention to provide a trigger type liquid injector, in which a discharge valve is adapted to be opened only when the pressure in a pump chamber exceeds a predetermined level to make the atomizing pressure higher than a predetermined level, so that a proper atomization can be established.

A secondary object of the present invention is to provide a trigger type liquid injector, in which the pump chamber of pumping means is arranged at an inclination with respect to a horizontal injection cylinder so that a piston member can be forced back and forth by engagement between the piston member and a trigger.

Another object of the present invention is to provide a trigger type liquid injector, in which the first air bleeding operation of the pump chamber is facilitated, in which evaluation of a liquid container can be prevented when the injector is mounted on the liquid container, and in which the closure of a nozzle and the state of the liquid being injected can be easily changed.

DESCRIPTION OF THE PREFERRED EMBODIMENT

Figure 1:
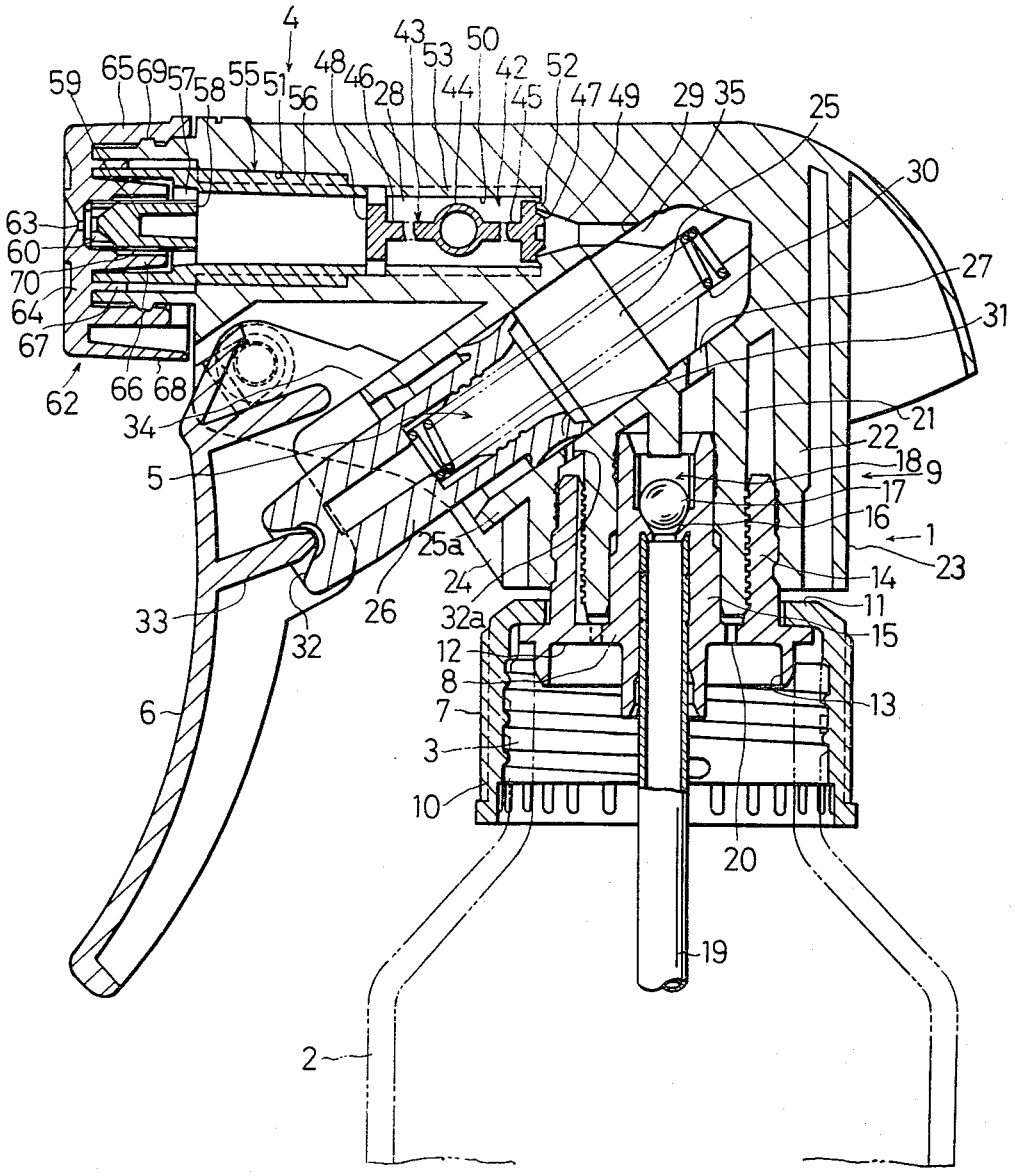
FIG. 1 is a longitudinally sectional side elevation showing a trigger type liquid injector according to the present invention.

The grip assembly 1 of the trigger type liquid injector according to the present invention is removably mounted on the neck 3 of a container 2 which contains the liquid to be injected. The body of the trigger type liquid injector is constructed of the grip assembly 1, an injection cylinder 4 protruding forward in a horizontal direction from the upper end of said grip assembly 1, and pumping means 5 inclined forward and downward from above the grip assembly 1. A trigger 6 for actuating the pumping means 5 is hinged at a position below the leading end portion of the injection cylinder 4 so that it can rock back and forth. The hinged position of the base of the trigger 6 should not be limited to the lower front side of the injection cylinder 4, as shown, but can be located at various positions, e.g., at the upper portion of the base of the injection cylinder 4, as is exemplified in the prior art, by bending the trigger 6.

In the shown embodiment, the grip assembly 1 is constructed of a mounting cap 7, a suction valve forming member 8 and leg 9 of the injector body.

The mounting cap 7 is formed such that a circumferential wall 10 to be fastened on the container neck 3 is made to extend downwardly from the circumferential edge of a top wall 11 top wall 11 is generally open at its center, except for the circumferential edge portion. The suction valve forming member 8 is formed with a top wall 12 which can have its circumferential edge portion placed on the mouth end of the container 1. There depends from the lower side of said top wall 12 a cylindrical portion 13 which is to be fitted on the inner wall of the container neck. A fitting cylinder 14 protrudes upward from the upper side of the top wall 12 through the opening of the top wall 11 of the mounting cap 7.

The top wall 12 has its circumferential edge portion engaging with the top wall 11 of the mounting cap 7. Moreover, the top wall 12 has its center portion formed witn a passage cylinder 15 which has both its end portions protruding up and down through that center portion. The passage cylinder 15 thus formed has its upper portion formed with a ball valve seat 16, on which a ball valve 17 is seated to provide a one-way suction valve 18 for allowing the liquid to flow unidirectionally in the upward direction. In the passage cylinder 15 below the valve seat 16, there is fitted the upper end of a suction pipe 19 which extends into the container body. The top wall 12 is provided with an air vent hole 20 between the passage cylinder 15 and the fitting cylinder 14. The leg 9 of the injector body is composed of three cylinders, an inner one 21 which is fitted between the upper portion of the passage cylinder 15 and the fitting cylinder 14, an intermediate one 22 which is fitted on the outer side of the fitting cylinder 14, and an outer one 23 which merges into the outer wall of the injector body. The outer cylinder 23 has its lower front half formed with an opening 24.

The aforementioned pumping means 5 is constructed of a pump chamber 25 and a piston member 26. Said pump chamber 25 is formed in the shape of a bore in the injector body and has its outside portion protruding as a cylindrical portion 25*a* toward the trigger 6. The pump chamber 25 has its interior portion formed with both a suction port 27, which has communication with the inside of the container 2 by way of the aforementioned suction valve 18, and a discharge port 29, which has communication with a hole 28 formed in the injection cylinder 4.

A coil spring 30 is mounted in the pump chamber 25, and a piston 31 is fitted on the leading end portion of the piston member 26 which can be forced inward against the biasing action of said spring 30. The piston member 26 has its outer end formed with a recessed portion 32, which is held in engagement with a protrusion 33 formed on the trigger 6. As a result, when the trigger 6 is squeezed toward the grip assembly 1, the spring 30 is compressed so that the piston 31 is forced deeply into the pump chamber 25. When the trigger 6 is released, the piston 31 is pushed back by the force of the spring 30 so that the trigger 6 is returned to its initial position. Incidentally, the trigger 6 has its base portion formed with a stopper 34, which determines the inoperative position of the trigger 6 when it abuts against the upper side of the cylindrical portion 25*a*. In the deep portion of the pump chamber 25, incidentally, there are provided a plurality of guide members 35 which are used to position the coil spring 30.

Figure 2:
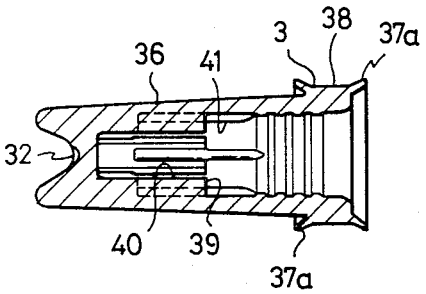
FIG. 2 is a longitudinally sectional side elevation showing a piston member constituting pumping means.
Figure 3:
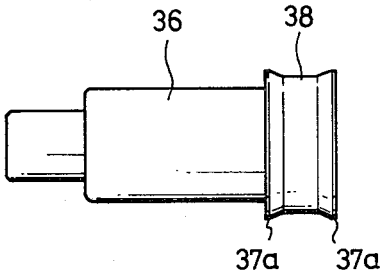
FIG. 3 is a top plan view showing the piston member.

The piston member 26 is made of a synthetic resin and is formed into such a cylinder portion 36 (FIG. 2) as has its outer end closed but its front portion opened. Said cylinder portion 36 has a generally cylindrical shape except its outer portion and has its inner portion formed into such an oval shape as has an elongated cross-section. A piston 31 is made integral with the cylinder portion 36 at the front portion of the piston member 26. Said piston 31 has its intermediate portion formed on its outer circumference with a groove portion 38 and both its inner and outer end portions formed their outer circumferences with such skirted portions 37*a* as bulge outward. Here, the skirted portions 37*a* of the piston 31 are made of a synthetic resin so that they can be elastically deformed.

The cylinder portion 36 has provided in the vicinity of the center of its inside, a stepped portion 39 for regulating the aforementioned spring 30. Said stepped portion 39 is defined by the leading end faces of a plurality of lands 40 and has formed in its inner surface with a plurality of lands 41 which are used to guide the spring 30 so that this spring 30 may not come out.

The cylindrical portion 25*a* defining the pump chamber 25 is formed with a communication hole 32*a* which is positioned to correspond to an intermediate position between the two skirted portions 37*a* when the piston member 26 comes to its outermost position. Said communication hole 32*a* is made to have communication with the aforementioned air vent hole 20 by way of the clearance which is defined between the fitting cylinder 14 of the suction valve forming member 8 and the inner cylinder 21 of the injector body leg 9. As a result, the inside of the container 2 must be evacuated in response to the reduction in the liquid as the injecting operation proceeds. However, this evacuation can be obviated because, since the communication hole 32*a* is not shut off by the piston 31 when the piston 31 is forced deeply into the pump chamber 25 by the squeezing action of the trigger 6, the atmospheric air is introduced into the inside of the container 2 from that communication hole 32*a* by way of the clearance which is formed between the fitting cylinder 14 of the suction valve forming member 8 and the inner cylinder 21 of the injector body leg 9.

Incidentally, the passage thus formed for introducing the ambient air is free from any liquid leakage, even if the injector falls down, because the communication hole 32*a* is blocked from the communication with the atmosphere by the piston 31 when the piston member 26 is in its inoperative position.

Figure 4:
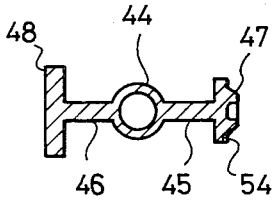
FIG. 4 is a sectional side elevation showing the valve member of a discharge valve.
Figure 5:
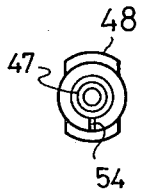
FIG. 5 is a back elevation showing the valve member.
Figure 6:
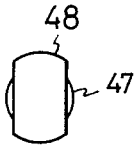
FIG. 6 is a front elevation showing the valve member.

At the back of the hole 28 of the injection cylinder 4, there is disposed a discharge valve 42 having a valve member 43, which is formed with rod portions 45 and 46 protruding from both the right and left outer sides of an elastic ring 44. One of the rod portions 45 is formed with a valve body 47 whereas the other rod portion 46 is formed with a fixed plate 48 having an oval shape. The hole 28 in the injection cylinder 4 is composed of a small diameter portion 49, an intermediate portion 50 and a large diameter portion 51. A stepped portion is formed between the small and intermediate diameter portions 49 and 50, and the small diameter portion 49 is formed in the vicinity of the intermediate diameter portion 50 with such a tapered portion as is diverged toward the intermediate diameter portion 50. Moreover, the stepped portion is formed at its neck with a valve seat land 52 which protrudes toward the intermediate diameter portion 50. Thus, the valve member 43 is fitted in the intermediate diameter portion 50 such that the valve body 47 is forced onto the leading end of said valve seat land 52. As better seen from FIGS. 4 and 5, the valve body 47 is formed with a small groove 54 for releasing the air under a high pressure. Here, the small groove 54 is so sized as to allow the air under pressure but not any liquid to pass therethrough so that the first air bleeding operation from the pump chamber 25 can be ensured to improve the atomizing function from the first time.

The fixed plate 48 is made to have a smaller diameter than the internal diameter of the intermediate diameter portion 50, and this portion 50 is formed in its inner wall with a suitable number of longitudinal grooves 53 thereby to ensure passage of the liquid. The fitting portion of the fixed plate 48 is formed in the intermediate diameter portion 50 at the side of the large diameter portion 51 and is made to have a slightly larger diameter than that of the remainder of the intermediate diameter portion 50. As a result, when the fixed plate 48 is forced into that portion from the side of the larger diameter portion 51, it is positioned in that portion. Thus, if the pressure in the pump chamber 25 is applied to the valve member 43, the elastic ring 44 is deformed and shortened so that the discharge port 29 can be opened. The fixed portion 48 closely contact with the inner wall of the intermediate diameter portion 50 in the longer diametrical direction thereof but leaves a clearance acting as a liquid passage between itself and the inner wall of the intermediate diameter portion 50 in the shorter diametrical direction thereof. At this time, the valve body 47 is forced into contact with the valve seat land 52 so that only the small groove 54 is opened. Here, the fixed plate 48 need not be formed into the oval shape but may have its body formed with a communication hole thereby to establish a liquid passage.

Figure 7:
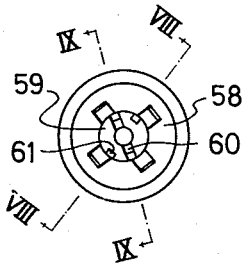
FIG. 7 is a front elevation showing a plug member which is mounted on the leading end portion of a injection cylinder.
Figure 8:
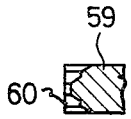
FIG. 8 is a sectional view showing the plug of the plug member, as viewed in the direction of arrows along line VIII—VIII of FIG. 7.
Figure 9:
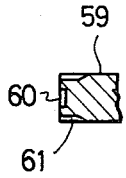
FIG. 9 is a sectional view showing the plug of the plug member, as viewed in the direction of arrows along line IX—IX of FIG. 7.

The cylindrical portion 56 of a plug member 55 is fitted in the large diameter portion 51. The plug member 55 is so constructed that a flange 58 formed with a suitable number of orifices 57 protruding from the inner wall of the front portion of the cylindrical portion 56 and that a plug 59 protrudes from the inner circumferential edge of said flange 58. The plug 59 is positioned in the leading end of the injection cylinder 4 outside of the flange 58. The plug 59 has its front end face formed in the diametrical direction with a diametrical groove 60, which is deepened at both its end portions, and has its front end face formed at its two edge positions with deep grooves 61 which are angularly spaced by about 60 degrees from the diametrical groove 60, as better seen from FIG. 7. The grooves 60 and 61 thus formed are made to have communications with the later-described grooves 70, which are formed in the inner circumferential wall of a nozzle cap 62, thus constituting a part of the discharge passage. Specifically, the depths of those grooves 60 and 61 of the plug 59 are determined in relation to the length of the grooves 70 which are formed in the inner circumferential wall of the nozzle cap 62.

Figure 10:
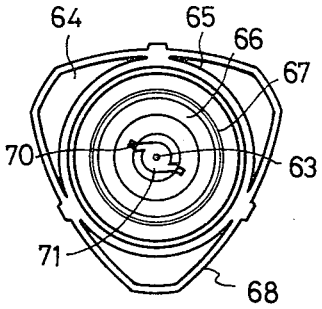
FIG. 10 is a back elevation showing a nozzle cap which is mounted on the leading end portion of the injection cylinder.

This nozzle cap 62 is rotatably fitted on the front end portion of the injection cylinder 4. The nozzle cap 62 is so constructed that an outer circumferential wall 65 fitted on the outer circumference of the front end portion of the injection cylinder 4 protrudes backward and an inner circumferential wall 66 fitted on the plug 59 also protrudes backward. From the rear side of the front end wall between those inner and outer circumferential walls 66 and 65, there protrudes an intermediate wall 67 which is fitted between the inner wall of the front end portion of the injection cylinder 4 and the outer wall of the front end portion of the cylindrical portion 56 of the plug member 55. In the embodiment shown, moreover, the front end wall 64 has its front side formed into such a triangular shape that a circumferential wall 68 having a triangular cross-section and partially merging into the outer circumferential wall 65 will protrude backward. Incidentally, inward engagement lands 69 made engageable with the lands of the outer circumference of the injection cylinder 4 are formed between the outer side of the injection cylinder 4 and the inner side of the outer circumferential wall 65 so that the nozzle cap 62 can be rotated, while being prevented from coming out of the injection cylinder 4, by the engagements between those lands. The aforementioned grooves 70 are formed in the inner side of the rear half portion of the inner circumferential wall 66 of the nozzle cap 62. The grooves 70 are made to have communications with the groove 60 and deep groove 61 of plug 59 and are formed in the diametrically opposite positions in the inner side of the inner circumferential wall 66. The rear side portion of the front end wall 64, which is surrounded by the inner circumferential wall 66, is formed, as shown in FIG. 10, with a spin groove 71 for swirling the liquid to be injected, and the nozzle hole 63 is positioned at the center of said spin groove 71.

Figure 11:
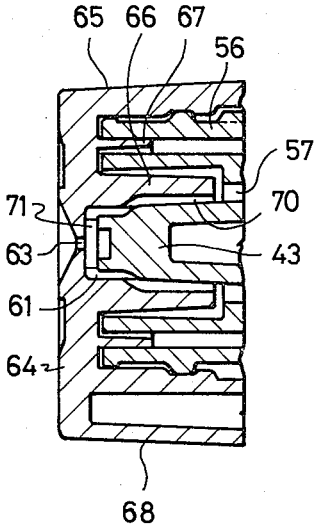
FIG. 11 is a sectional view showing the nozzle cap portion positioned at an atomizable state.

The operations of the trigger type liquid injector having the construction thus far described will now be discussed. By turning the nozzle cap 62, the grooves 70 of the inner circumferential wall 66 of the nozzle cap 62 and the deep grooves 61 and spin groove 71 of the plug 59 are made to have communications with one another, as shown in FIG. 11. If the trigger 6 is squeezed toward the grip assembly 1, the piston 37 is forced into the pump chamber 25 so that the pressure in the pump chamber 25 is boosted because the suction valve 18 and the discharge valve 42 are blocked from each other at this time. Under the condition in which air existing in the pump chamber 25, the air thus boosted is discharged from the small groove 54 of the valve body 47. If the trigger 6 is then released, the piston 37 is returned by the biasing force of the spring 30 to thereby evacuate the inside of the pump chamber 25 so that the suction valve 18 is opened to suck the liquid from the container into the pump chamber 25. If the trigger 6 is squeezed again, the discharge valve 42 is opened by the boosted pressure of the liquid in the pump chamber 25 through the elastic deformation of the elastic ring 44 so that the liquid under high pressure is ejected from the nozzle hole 63 through the discharge valve 42 and further through the orifices 57, the grooves 70, the deep grooves 61 and the spin groove 71. Since the liquid thus ejected passes through the spin groove 71, it is ejected, while being swirled at a high velocity, in the form of fine vapors. When the trigger 6 stops, the piston 37 is halted, too. Then, simultaneously as the high pressure in the pump chamber 25 is released, the discharge valve 42 is closed so that the atomization is instantly halted.

If the grooves 70 in the inner circumferential wall 66 of the nozzle cap 62 and the deep grooves 61 and spin groove of the plug 59 are made to have communications, as has been described above, the ejected liquid is atomized. However, the liquid can be ejected without atomization in a syringe operation. In this latter operation, it is necessary to establish communications between the grooves 70 in the inner circumferential wall 66 of the nozzle cap 62 and the diametrical groove 60 in the plug 59, as shown in FIG. 1. In that particular operation, the liquid is ejected from the nozzle hole 63 through the groove 60 of the plug 59, while not being swirled, so that it is ejected at an unatomized state.

Figure 12:
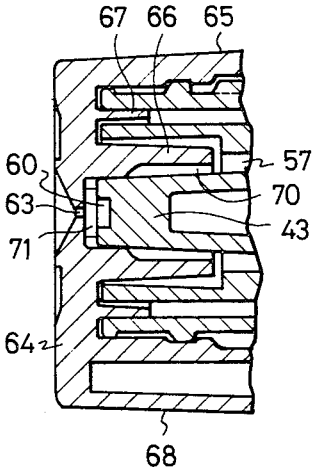
FIG. 12 is a sectional view showing the nozzle cap portion positioned at a second atomizable state.

On the other hand, if the nozzle cap 62 is further turned to block communications among the grooves 70 in the circumferential wall of the nozzle cap 62 and the diametrical groove 60 and deep grooves 61 of the plug 59, as shown in FIG. 12, the liquid in the pump chamber 25 cannot be discharged. As a result, the trigger cannot be squeezed.

As has been described hereinbefore, according to the present invention, only when the liquid in the pump chamber exceeds a predetermined level is the discharge valve opened so that the atomization of the liquid ejected from the nozzle hole can always be effected. Moreover, the pump chamber which is opened toward the aforementioned trigger is disposed at the internal angular position between the grip assembly and the injection cylinder, while slidably receiving the piston at the leading end of the piston member, and the recessed portion formed in the leading end of said piston member and the protrusion formed on the inner side of the trigger are held in engagement with each other. Therefor, the actuations of the piston by the squeezing action of the trigger can be performed easily without any difficulty. Moreover, since the spring for returning the piston member is mounted in the pump chamber, it does not obstruct movement of the trigger.

Still moreover, since the pumping means is disposed at the internal angular portion between the injection cylinder and the body leg and since the piston member and the spring are mounted in the pump chamber, the grip assembly and the injection cylinder do not have excessively large diameters and/or lengths, as in assemblies in which the pumping means is mounted in either the grip portion or the injection cylinder. As a result, the size of the liquid injector as a whole can be reduced. On the other hand, if the discharge valve is so elastically closed that it must be opened by the liquid under high pressure, it becomes difficult, during the initial use if there is air still left in the pump chamber, to scavenge said pump chamber and to charge the container with the liquid. Since, however, the small groove acting as the high pressure air discharging passage is provided according to the present invention, the air under a high pressure is discharged from the pump chamber if trigger is squeezed and held in the squeezed condition. As a result, if the trigger is released so that the piston is returned by the spring, the pump chamber is evacuated to suck the liquid from the container. Thus, the replacement between the air in the pump chamber and the liquid in the container can be performed without any difficulty.

Still moreover, since the nozzle cap is made rotatable, more specifically, since the nozzle cap is rotationally positioned between the outer circumferential wall of the plug and the inner side of the inner circumferential wall of the nozzle cap and between the front end face of the plug and the rear side of the front end wall of the nozzle cap thereby either to form the communicating discharge passage or to block the liquid injection, the liquid can be prevented from being mistakenly ejected.

What is claimed is:

1. A trigger type liquid sprayer, comprising:

a pumping means for effecting suction of a liquid from a container, said pumping means comprising a cylindrical pump chamber, a spring and a piston member movable within said cylindrical pump chamber against the biasing force of the spring, a trigger mechanism for effecting movement of said piston member;

a suction valve for regulating the flow of said liquid into said cylindrical pump chamber from a liquid container;

means for regulating the movement of said liquid from said cylindrical pump chamber, said means for regulating comprising a nozzle mounted on the end of a horizontally oriented injection cylinder, said injection cylinder comprising a discharge valve, a small diameter cylinder, an intermediate diameter cylinder, a large diameter cylinder, and a circular plug, said discharge valve being positioned in the intermediate diameter cylinder and including an elastic ring with first and second diametrically opposed horizontal extensions, said first horizontal extension terminating in a valve structure for regulating the flow of said liquid through said intermediate diameter cylinder from said small diameter cylinder, a discharge port being disposed in said injection cylinder opposite said nozzle, said second horizontal extension terminating in a plate structure which regulates the flow of said liquid from said intermediate diameter cylinder to said large diameter cylinder, the end of said large diameter cylinder furthest from said plate structure being fitted with said circular plug, said circular plug having orifices for allowing passage of said liquid from said large diameter cylinder to said nozzle structure;

said large diameter cylinder being lined with a hollow cylindrical member having an opening therethrough, said cylindrical member extending between said discharge valve and said circular plug.

2. A trigger type liquid sprayer in accordance with claim 1, wherein:

said circular plug comprises a flange fitted into the opening of said cylindrical member, said flange having orifices about its periphery and an opening in its center, said opening in the center of said flange being fitted with a second plug.

3. A trigger type liquid sprayer in accordance with claim 1, wherein:

said piston member has a hollow region with notches therein for guiding said spring;

said cylindrical pump chamber having a vent hole which is obstructed by said piston when said piston is moved to its innermost position and unobstructed when said piston is at its outermost position;

said container having a passage which communicates with the atmosphere when said vent hole is obstructed.

4. A trigger device in accordance with claim 1, wherein:

said valve structure for regulating the flow of said liquid through said intermediate to said large diameter cylinder has at least one small groove to allow liquid under pressure to pass therethrough at all times.

5. A trigger type liquid sprayer in accordance with claim 1, wherein:

said second plug fitted into the opening in the center of said flange has at least two different types of grooves therein;

said nozzle has grooves having selective communication with said different types of grooves; and said selective communication allows for changing the state of the liquid ejected from said nozzle.

6. A trigger type liquid injector in accordance with claim 1, 2, 3, 4 or 5 wherein:

said nozzle has a dual cylinder construction for changing the state of the liquid ejected therefrom.

* * * * *